US006293040B1

(12) United States Patent
Luth

(10) Patent No.: US 6,293,040 B1
(45) Date of Patent: Sep. 25, 2001

(54) INTERCHANGEABLE WEAPON RECEIVER FOR ALTERNATE AMMUNITION

(75) Inventor: Randy E. Luth, Becker, MN (US)

(73) Assignee: Defense Procurement Manufacturing Services, Inc., Becker, MN (US)

( * ) Notice: Subject to any disclaimer, the term of this patent is extended or adjusted under 35 U.S.C. 154(b) by 0 days.

(21) Appl. No.: 09/384,907

(22) Filed: Aug. 27, 1999

(51) Int. Cl.[7] ..... F41A 21/48

(52) U.S. Cl. ..... 42/75.01; 42/75.02; 42/75.04; 42/77; 89/128

(58) Field of Search ..... 89/29, 128; 42/1.15, 42/75.01, 75.02, 75.04, 77, 105

(56) References Cited

U.S. PATENT DOCUMENTS

| | | | | |
|---|---|---|---|---|
| 3,198,076 | * | 8/1965 | Stoner | 89/128 |
| 3,380,183 | * | 4/1968 | Miller et al. | 42/75 |
| 3,776,095 | * | 12/1973 | Atchisson | 89/128 |
| 4,220,071 | * | 9/1980 | Seiderman | 89/128 |
| 4,542,606 | * | 9/1985 | Hoenig | 42/75 B |
| 4,648,192 | * | 3/1987 | Harness | 42/77 |
| 4,729,186 | * | 3/1988 | Rieger | 42/75.04 |
| 4,733,489 | * | 3/1988 | Kurak | 42/77 |
| 5,225,610 | * | 7/1993 | Uria | 42/40 |
| 5,228,887 | * | 7/1993 | Mayer | 42/75.02 |
| 5,410,834 | * | 5/1995 | Benton | 42/75.02 |
| 5,719,349 | * | 2/1998 | Canaday et al. | 89/1.816 |

OTHER PUBLICATIONS

Machine Gun News, Nov. 1996, p. 42.
Light Support Weapons/USA, pp. 212, 213, 214.
Advertisement of J.C. Manufacturing, Inc.
DPMS Assembly Drawings—16 sheets.
Drawing No. 9349000.
USA/Rifles, p. 173.

* cited by examiner

*Primary Examiner*—Charles T. Jordan
*Assistant Examiner*—John Richardson
(74) *Attorney, Agent, or Firm*—Patterson, Thuente, Skaar & Christensen, P.A.

(57) ABSTRACT

An interchangeable upper receiver assembly for use with a hand held weapon and the interchangeable upper receiver assembly in combination with the hand held weapon, where the interchangeable upper receiver assembly includes an integral, unitary breech block and barrel that is operably removably couplable to the lower receiver assembly of the hand held weapon in an engaged disposition. A bolt assembly is slidably disposed within a bolt recess defined in the receiver breech block and barrel. The bolt includes a firing pin slidably disposed therein, the firing pin being selectively actuatable by the trigger assembly when the receiver is in the engaged disposition. A chamber for receiving a secondary ammunition cartridge therein is defined in the receiver and is disposed with respect to the firing pin such that actuation of the firing pin from a cocked position to a firing position acts upon the secondary ammunition cartridge to discharge the cartridge, the interchangeable upper receiver assembly being interchangeable with a primary upper receiver assembly of the hand held weapon.

9 Claims, 5 Drawing Sheets

INTERCHANGEABLE WEAPON RECEIVER FOR ALTERNATE AMMUNITION

TECHNICAL FIELD

The present invention relates to hand-held weapons. More particularly, the present invention is an interchangeable unitary receiver for use with an existing hand-held weapon in order to permit the discharge of an alternate type of ammunition.

BACKGROUND OF THE INVENTION

As depicted in FIG. 6, the prior art rifle weapon 20 has a lower receiver assembly 22. In the usual configuration of weapon 20, an upper receiver assembly 24 is mated to the lower receiver assembly 22.

The lower receiver assembly 22 of the weapon 20 has three major subcomponents: lower receiver 26, butt stock 28, and pistol grip 30. In assembly, the butt stock 28 is slid over the buffer tube 32 and secured to the lower receiver 26. Preferably, the buffer tube 32 has a buffer spring (not shown) and a buffer body assembly (not shown) disposed therein. The butt stock buffer spring and the buffer body assembly cooperate to minimize the recoil felt by the operator of the weapon 20 during discharge of ammunition therefrom when in the rifle mode of operation with the original upper receiver assembly 24 installed.

The pistol grip 30 is secured to the underside of the lower receiver 26 preferably by a screw (not shown) threaded into a threaded bore (not shown) disposed in the underside of the lower receiver 26.

A magazine receiver 34 is positioned in the forward portion of the lower receiver 26. The magazine receiver 34 has an aperture 36 defined therein. The aperture 36 is open at both the top and the bottom. The top opening 38 of the aperture 36 is designed to admit cartridges into the upper receiver assembly 24 for discharge therefrom.

The lower opening 40 of the aperture 36 is designed to receive a magazine inserted therein. The magazine (not shown) is held within the magazine receiver 34 by the magazine catch 42.

A trigger assembly 44, including a trigger 46, is positioned within the lower receiver 26 and held in position by pin 48. A hammer assembly 50 is also disposed within the lower receiver 26 and held in position by pin 52. The trigger assembly 44 and the hammer assembly 50 are disposed in a cooperative relationship such that when the hammer assembly 50 is in a cocked condition, actuation of the trigger 46 of the trigger assembly 44 acts to release the hammer assembly 50 to strike the primer of a cartridge, thereby discharging a cartridge loaded in the chamber 53 of the upper receiver assembly 24.

The upper receiver assembly 24 of the prior art weapon 20 typically includes two major subcomponents: upper receiver 60 and barrel assembly 62. The barrel assembly 62 has a barrel 64. The barrel 64 may have a compensator 66 at the muzzle end 68 thereof that is held in threaded engagement with the threads 70 of the barrel 64. A front sight 72 may be mounted on the forward portion of the barrel 64. A gas tube 74 may extend rearward from proximate the front sight 72 mounted on the barrel 64. The gas tube 74 supplies gas under pressure to the upper receiver 60 to assist in ejection of a spent cartridge (not shown) and the loading of a live cartridge (not shown) from the magazine. A pair of hand guards 76 are positioned around a portion of the barrel 64.

The rear portion of the barrel 64 has a barrel nut 78 designed to threadedly engage the barrel assembly 62 with the threads 79 of the upper receiver 60. A hand guard retainer 77 slides over the barrel nut 78 and fixes the hand guards 76 to the barrel 64.

The upper receiver 60 has an integral carrying handle 80. An aperture 82 defined in the side of the upper receiver 60 permits actuation of a bolt disposed within the upper receiver 60.

In the lower front portion of the upper receiver 60 is a downward directed forward locking lug 84. In the rear portion of the upper receiver 60 is a downward directed rear locking lug 86. The forward locking lug 84 and the rear locking lug 86 each have a single lug bore 88 defined therein. The lug bores carry through the respective locking lug 84, 86 from side to side. When the upper receiver assembly 24 is mated to the lower receiver assembly 22 of the weapon 20, the lug bore 88 of the forward locking lug 84 is positioned in registry with a receiver bore 90 defined in the side of the lower receiver 26. The lug bore 88 of the rear locking lug 86 is positioned in registry with the rear receiver bores 92. Locking pins 94 are then inserted through the receiver bore 90 and the lug bore 88 of the forward locking lug 84 and through the rear receiver bore 92 and the lug bore 88 of the rear locking lug 86 to removably secure the upper receiver assembly 24 to the lower receiver assembly 22 of the weapon 20. It should be understood that it is contemplated in the design of the weapon 20 that the locking pins 94 may be readily disengaged in order to permit the upper receiver assembly 24 to be detached from the lower receiver assembly 22.

Most weapons of the type described above are designed to discharge a primary type of ammunition. Typically such ammunition propels a relatively small caliber projectile at very high velocity. In order to balance the fire power of a force comprised of a number of individuals, there is a need to discharge alternate ammunition. Such ammunition may comprise a relatively large caliber grenade or flare, or a shotgun type shell. Also a chemical dispensing cartridge may be used such as a tear gas cartridge. Further, rifle and pistol cartridges of different size and caliber than the primary ammunition may be desired to be discharged.

In the past, an add on tube was designed to be mounted on an existing hand held weapon. Such add on tube is evidenced in the M203 grenade launcher adaptable to the M-16A1 rifle produced by J. C. Manufacturing, Inc. An alternative approach to providing the versatility in fire power was to design a weapon dedicated to discharging only the alternate type ammunition.

There are certain disadvantages attendant to the foregoing means for providing an alternative ammunition capability. With respect to the add on tube, the sight system on the hand held weapon that are set up for the ballistics of the primary ammunition are not readily adaptable to provide the user accurate information regarding the deployment of the alternative ammunition. Additionally, the add on tube adds complexity and weight to the existing hand held weapon. With respect to the weapon dedicated to the discharge of alternate ammunition, the member of the armed force carrying such dedicated weapon is denied the ability to use the primary ammunition when the situation calls for such use, unless an additional hand held weapon is carried by that member. Further, there is a need to have all the members of a force carry the same type of weapon. By arming some of such members with a weapon dedicated to the discharge of alternate ammunition, such commonality is not maintained.

Accordingly, the need to be able to discharge a variety of different types of ammunition remains. Such discharge should be affected with a single hand held weapon that is capable of being configured to discharge the primary ammunition as well as the alternate ammunition as desired. The breech block and barrel assembly of the receiver should be integrally formed to ensure that the receiver is capable of repeatably discharging in rapid succession the most intense ammunition available. Additionally, when configured to discharge alternate ammunition, a suitable sighting system for such ammunition should be provided. Such a device should minimize the complexity and weight added to an existing hand held weapon.

SUMMARY OF THE INVENTION

The present invention substantially meets the aforementioned needs of the industry. The interchangeable receiver of the present invention is readily interchanged with an existing receiver of the hand held weapon in order to convert the weapon from the capability of discharging a primary ammunition to the ability to discharge an alternate ammunition. The invention is described with respect to what is known as the M-16 or AR-15 rifle. It is understood that the present invention can be used on other rifles, as well. Additionally, the interchangeable receiver includes a sight system that is set up for the particular ballistics of the alternative ammunition being discharged. The sight system for the primary ammunition is integral with the receiver for the primary ammunition and is removed from the hand held weapon. when the interchangeable receiver is put in place.

The caliber and chamber of the present invention may be made to accommodate a large number of different cartridges, including a grenade or flare cartridge, a shotgun type shell, and other rifle or pistol cartridges, as desired. Also a chemical dispensing cartridge may be used such as a tear gas cartridge.

The interchangeable receiver of the present invention can be easily used by any member of a force having the particular hand held weapon for which the interchangeable receiver is adapted. By being interchangeable with an existing receiver, the interchangeable receiver of the present invention minimizes the complexity and weight added to the hand held weapon for which it is designed.

The present invention is an interchangeable upper receiver assembly for use with a hand held weapon includes a receiver that is operably removably couplable to the lower receiver assembly of the hand held weapon in an engaged disposition. The interchangeable upper receiver assembly includes a receiver having an integral, unitary breech block and barrel assembly. A bolt assembly is slidably disposed within a bolt recess defined in the receiver. The bolt includes a firing pin slidably disposed therein, the firing pin being selectively actuatable by the trigger assembly when the receiver is in the engaged disposition. A chamber for receiving a secondary ammunition cartridge therein is defined in the receiver and is disposed with respect to the firing pin such that actuation of the firing pin from a cocked position to a firing position acts upon the secondary ammunition cartridge to discharge the cartridge, the interchangeable upper receiver assembly being interchangeable with a primary upper receiver assembly of the hand held weapon. The invention further includes the interchangeable upper receiver assembly in combination with the hand held weapon.

DETAILED DESCRIPTION OF THE DRAWINGS

Figure 1:
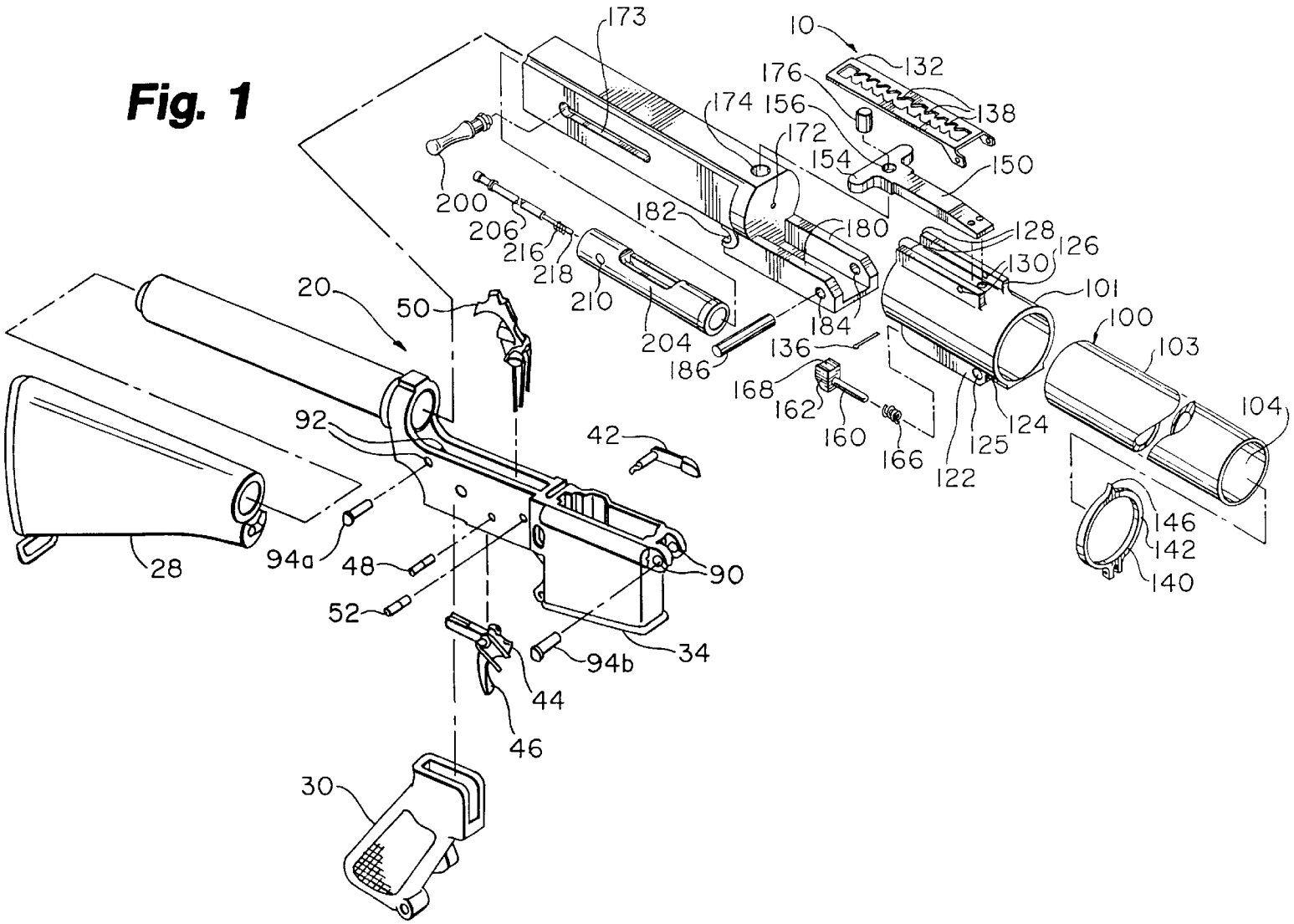
FIG. 1 is an exploded perspective view of the lower receiver assembly of a hand held weapon in combination with the interchangeable receiver of the present invention.

The interchangeable weapon receiver 10 of the present invention is depicted in FIGS. 1–5. The interchangeable weapon receiver 10 is designed to be utilized with the lower receiver assembly of the exemplary prior art weapon 20. It is understood that the interchangeable weapon receiver 10 of the present invention may be readily adapted to a number of different types of weapons having a configuration that includes both an upper receiver assembly and a lower receiver assembly.

With respect to FIGS. 1–5, the interchangeable weapon receiver 10 of the present invention is designed to readily replace the upper receiver assembly 24 of the weapon 20. The interchangeable weapon receiver 10 is what may be termed a single shot device as distinct with what may be termed an automatic or semiautomatic device. Accordingly, a cartridge 98 (see FIG. 3) must be manually loaded for each discharge of the cartridge 98. The interchangeable weapon receiver 10 has two major subcomponents: barrel assembly 100 and receiver assembly 102.

Figure 2:
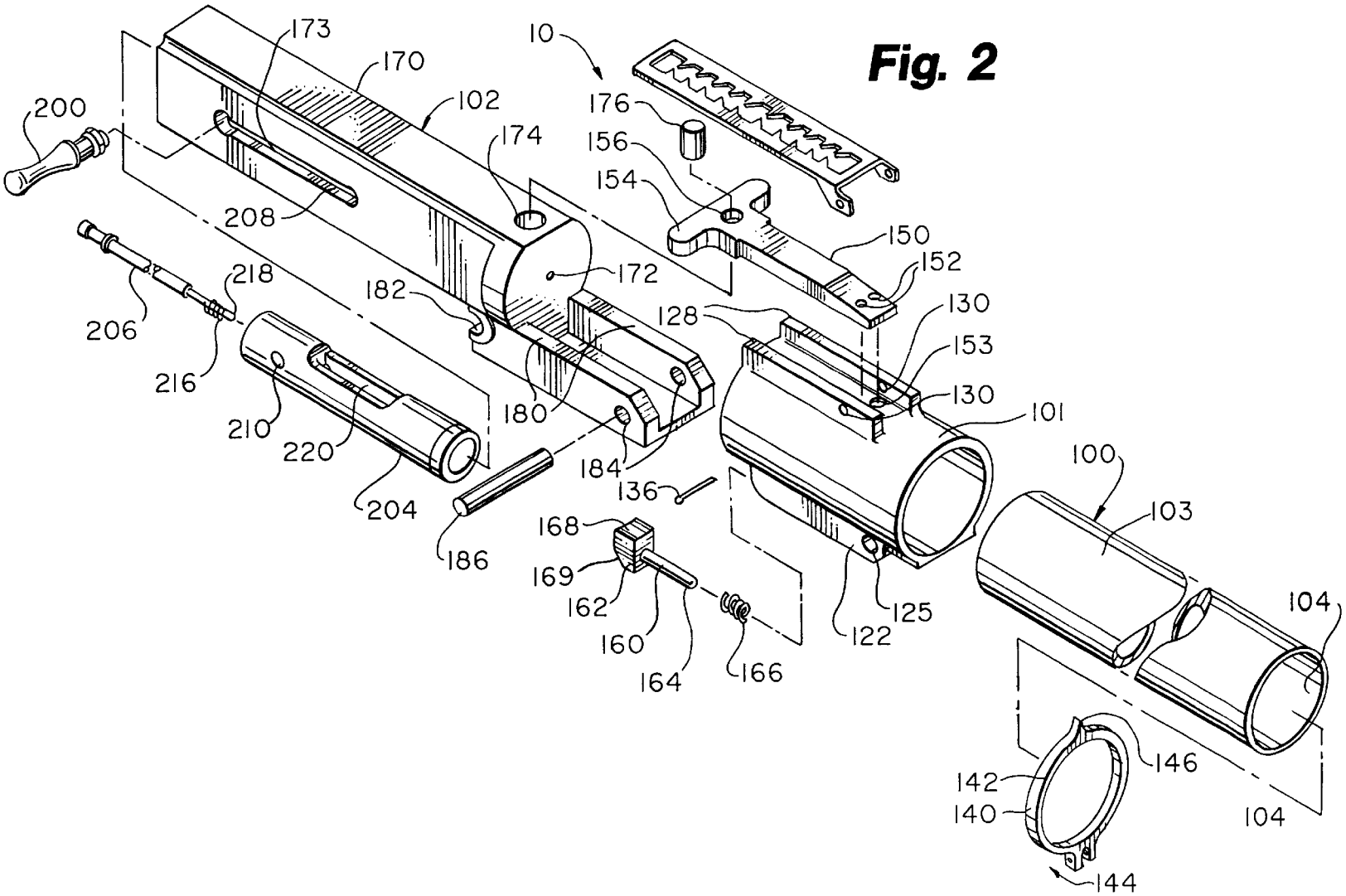
FIG. 2 an exploded perspective view of the interchangeable receiver of the present invention.
Figure 3:
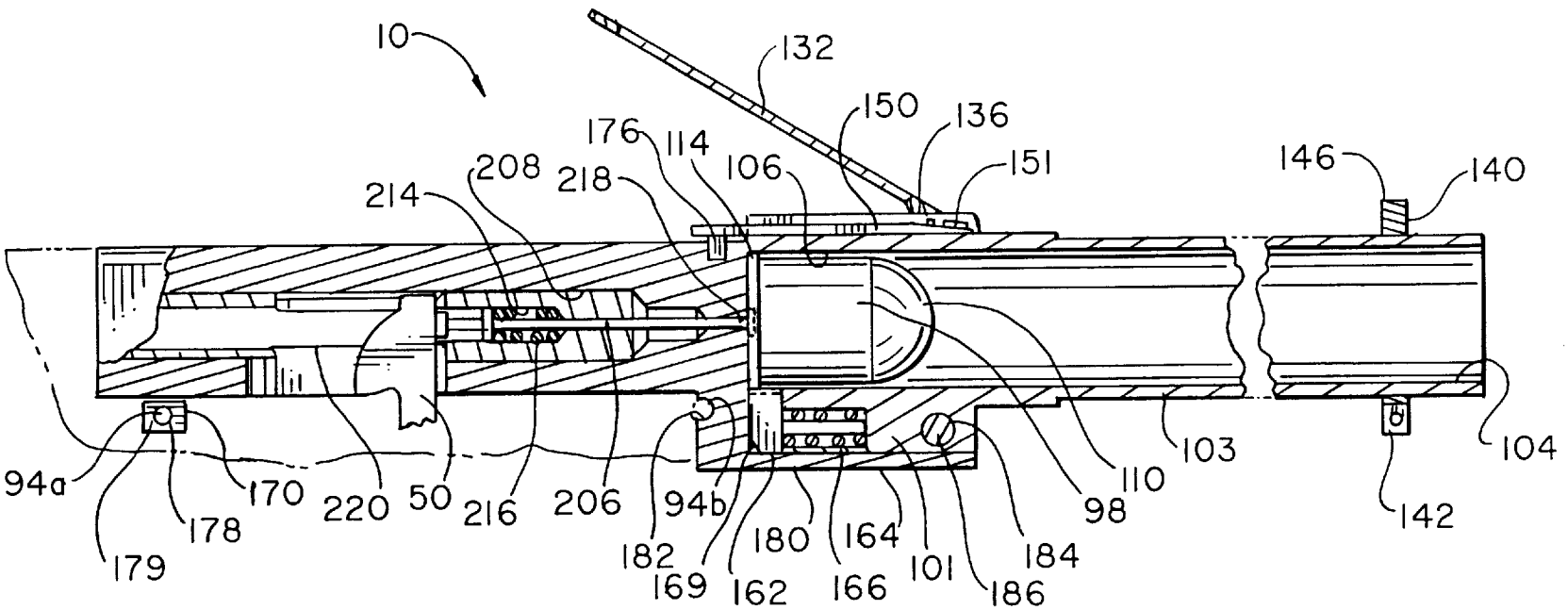
FIG. 3 is a side sectional view of the interchangeable receiver with a projectile loaded in the chamber, the receiver having an integral breech block and barrel.

The barrel assembly 100 has a breech block 101 operably coupled to a barrel assembly 103. In the embodiment of FIGS. 1 and 2, the breech block 101 and the barrel assembly 103 are formed of two separate components that are then pressed together. In the embodiment of FIG. 3, the breech block 101 and the barrel assembly 103 are formed integrally as a unit. Such formation, though more difficult and expensive to form, has a greater inherent strength and is useful where more intensely powered ammunition is desired to be repeatably discharged in rapid succession, such use imposing the most severe pressure and heat conditions on the breech block 101 and the barrel assembly 103.

The barrel 103 of the barrel assembly 100 preferably has a smooth bore 104 defined therein. The bore 104 is sized appropriately to accommodate the particular projectile that is desired to be discharged through the barrel 103. The bore 104 may be rifled as desired depending upon the type of projectile to be discharged therethrough. In a preferred embodiment, the inside diameter of the barrel 103 accommodates 37 and 40 mm sized cartridges.

A chamber 106 is defined proximate the rear portion of the barrel assembly 102. The chamber 106 is designed to admit an appropriately sized cartridge 98 therein. The cartridge 98 preferably has a projectile 110 disposed within a cartridge case 112. The cartridge case 112 has a rim 114 defined proximate the rear portion thereof. The chamber 106 is designed to engage the rim 114, thereby holding the cartridge 98 in the chamber 106.

The breech block 101 is disposed exterior to the barrel 103 of the barrel assembly 102. The breech block 101 has a pair of opposed downwardly directed lugs 122. A slot 124 is defined between the lugs 122. A forward locking pin bore 125 extends through each of the lugs 122.

A sight retainer 126 is disposed at the top portion of the chamber shroud 120. The sight retainer 126 has spaced apart sight lugs 128. A sight bore 130 is defined through both of the sight lugs 128.

A ramp sight 132 is positioned between the two sight lugs 128 and rotatably coupled thereto by a pin 136 that is passed through the bores 134 in registry with the sight bores 130. The ramp sight 132 has a plurality of ramped apertures 138 that each correspond to a sight setting for a desired range over which the projectile 110 is to travel. The ramp sight 132 functions in cooperation with the front fixed sight 140.

The front fixed sight 140 is comprised of a band 142 that is disposed circumferential to the barrel 103 and affixed thereto by a screw 144. The front fixed sight 140 has an upwardly directed sight blade 146.

A breech locking tab 150 is secured to the upper portion of the breech block 101 by screws 151 passing through bores 152 and into threaded bores 153 defined in the breech block 101. The breech locking tab 150 is rearwardly directed with respect to the breech block 101 and overlies a portion of the receiver assembly 102 when in the locked disposition. A thumb tab 154 is disposed at either side of the breech locking tab 150 proximate the distal end thereof. A pin bore 156 that passes through the breech locking tab 150 is disposed generally between the two thumb tabs 154.

An ejector assembly 160 is disposed in the lower portion of the breech block 101. The ejector assembly 160 has a head 162 coupled to a shank 164. A coil spring 166 is disposed concentric with the shank 164 and acts to bias the ejector assembly 160 in a rearward disposition. The ejector assembly 160 has a curved surface 168 formed as the upper margin of the head 162. The curvature of the curved surface 168 is designed to generally conform with the curvature of the cartridge case 112. A beveled face 169 is formed in the lower front portion of the head 162.

Figure 4:
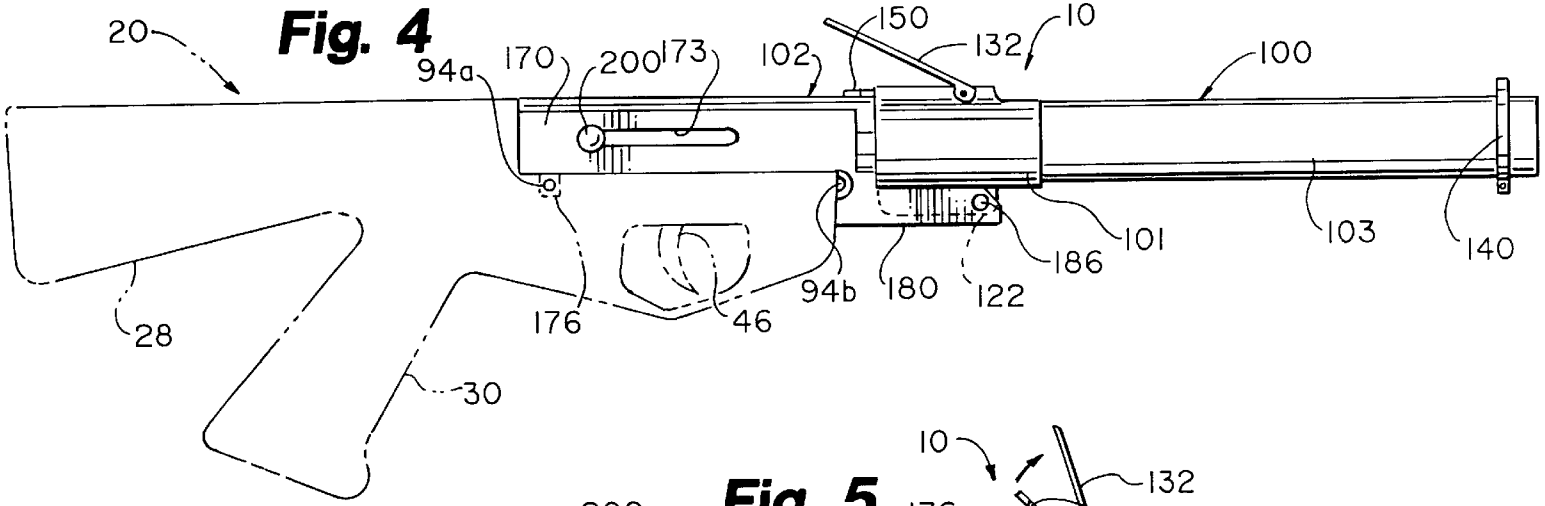
FIG. 4 is a side elevational view of the interchangeable receiver integrated with the lower receiver of FIG. 1 depicted in phantom, the interchangeable receiver being in the locked disposition.

The receiver assembly 102 has a generally tubular receiver body 170. The receiver body 170 has a firing pin aperture 172 defined in a forward directed margin thereof. An elongate charging handle aperture 173 is defined in a right side margin of the receiver body 170. An upwardly opening pin bore 174 is disposed on the upper surface of the receiver body 170 proximate the forward end thereof. A pin 176 is preferably press fit into the pin bore 174. A portion of the pin 176 projects above the upper margin of the receiver body 170. The upwardly directed pin 176 engages the pin bore 156 of the breech locking tab 150 to lock the barrel assembly 100 in the closed firing disposition with the receiver assembly 102, as depicted in FIGS. 3 and 4.

A downwardly directed rear locking lug 179 is disposed at the rear underside of the receiver body 170. See FIG. 3. The rear locking lug 179 has a locking bore 178 defined therethrough. When the interchangeable weapon receiver 10 is mated to the lower receiver assembly 22 of the weapon 20, the locking bore 178 is in registry with the rear receiver bores 92.

A pair of forwardly directed forward locking lugs 180 are disposed at the front underside of the receiver body 170. The forward locking lugs 180 have a rear facing locking groove 182 defined therein. When the interchangeable weapon receiver 10 is mated to the lower receiver assembly 22 of the weapon 20, the locking groove 182 is in registry with the forward receiver bores 90. A pair of locking bores 184 are in registry with each other and are disposed proximate the forward margin of the forward locking lugs 180. A pivot pin 186 pivotally joins the receiver assembly 102 and the barrel assembly 100 by passing through the bore 125 of the barrel assembly 100 and the pair of locking bores 184 when the pair of locking bores 184 are brought into registry with the bore 125 of the barrel assembly 100.

A charging handle 200 passes through the charging handle aperture 173 defined in the receiver body 170. The charging handle 200 is operably coupled to the bolt housing 204 such that forward and rearward motion of the charging handle 200 accompanies forward and rearward motion of the bolt housing 204. Rearward motion of the charging handle 200 acts to cock the weapon 20 by moving the bolt housing 204 rearward and cocking the hammer assembly 50.

The bolt housing 204 is slidably received in a bolt enclosure 208 defined in the receiver body 170 of the receiver assembly 102. See FIG. 3. The charging handle 200 is fixedly received in a bore 210 defined in the right side of the bolt housing 204 for actuation of the bolt housing 204.

A firing pin 206 is translatably disposed in the firing pin carrier 214 defined in the bolt housing 204. The firing pin is biased rearward in the carrier 214 by the spring 216. The firing pin striker 218 is aligned in registry with the firing pin aperture 172. A hammer slot 220 is defined in the lower portion of the bolt housing 204. The hammer slot carries through the bolt housing 204 to intersect the firing pin carrier 214. The hammer slot accommodates the hammer 50 as the hammer 50 rotates to strike to the rear of the firing pin 206.

Figure 6:
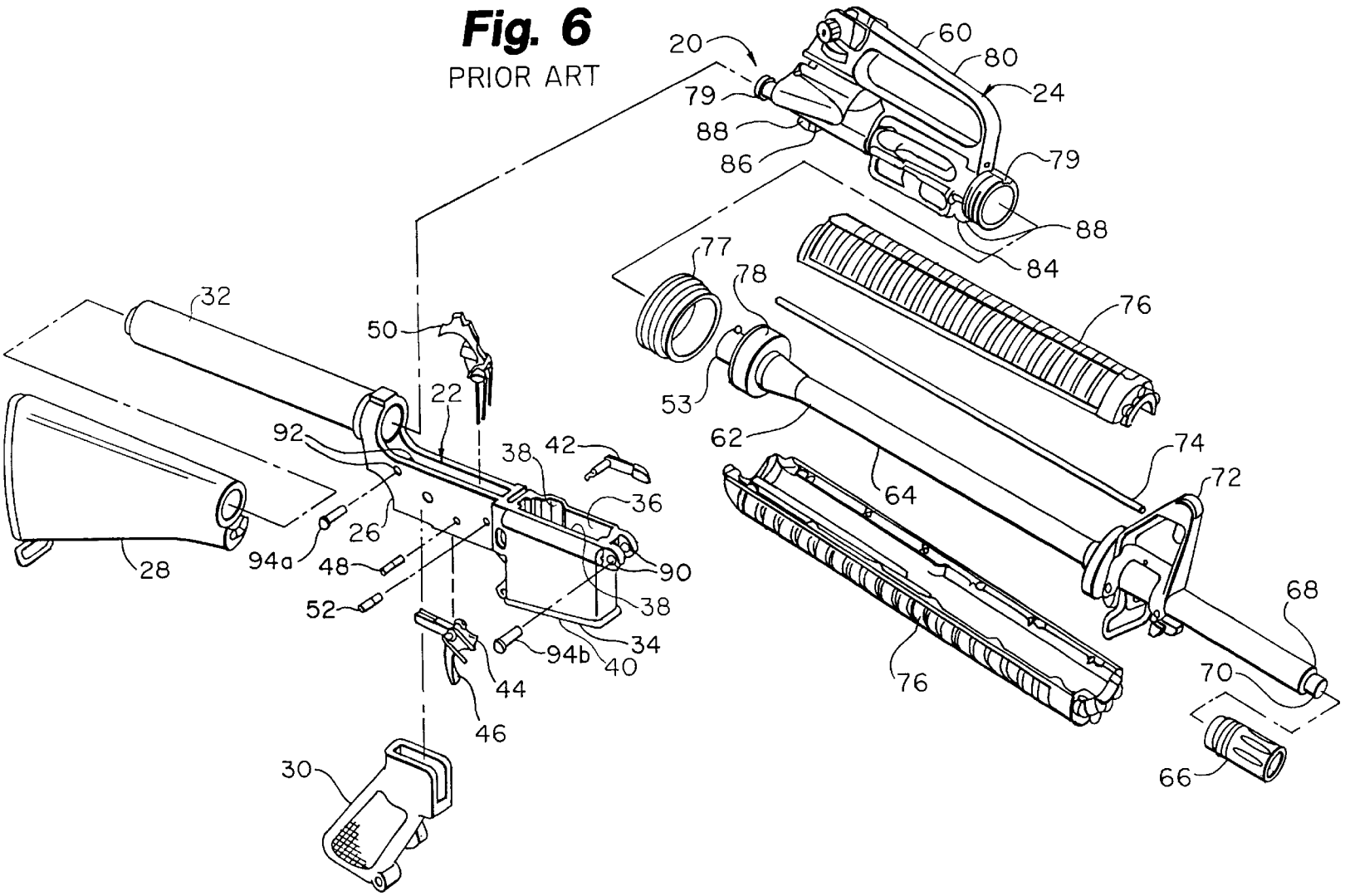
Fig. 6 PRIOR ART
FIG. 6 is an exploded perspective view of the lower receiver assembly, upper receiver assembly, and barrel of a prior art weapon.

In operation, the upper receiver assembly 24 of the prior art weapon 20, as depicted in FIG. 6, is disengaged from the lower receiver assembly 22 by pushing out the two locking pins 94*a*, 94*b* and rotating the upper receiver assembly 24 away from the lower receiver assembly 22. The interchangeable weapon receiver 10 of the present invention is then rotated into engagement with the lower receiver assembly 22. This action brings the locking groove 182 into registry with the forward receiver bores 90 and the locking bore 178 into registry with the rear receiver bores 92. The two locking pins 94*a*, 94*b* are then reengaged, locking pin 94*a* engaging both the locking bore 178 and the rear receiver bores 92 and locking pin 94*b* engaging both the locking groove 177 and the forward receiver bores 90. By the aforementioned simple sequence of actions, the weapon 20 has been readily converted from having the capability to discharge standard ammunition to having the capability to discharge alternative ammunition with the interchangeable weapon receiver 10 in place.

Figure 5:
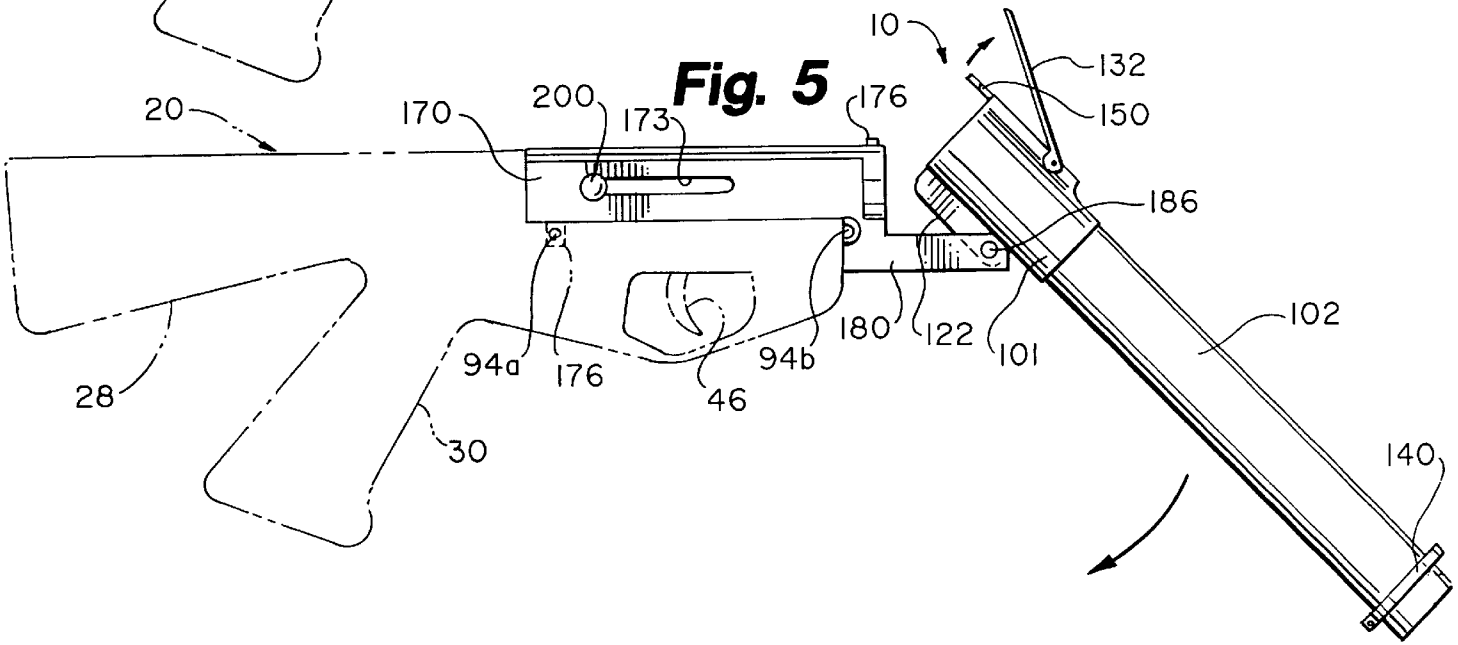
FIG. 5 is a side elevational view of the interchangeable receiver integrated with the lower receiver of FIG. 1 depicted in phantom, the interchangeable receiver being in the open disposition.

Referring to FIGS. 3 and 4, barrel assembly 100 of the interchangeable weapon receiver 10 is held in the locked disposition by the upwardly directed pin 176 engaging the pin bore 156 on the breech locking tab 150. To unlock the barrel assembly 100, an ear 154 of the breech locking tab 150 is deflected upward, disengaging the pin bore 156 from the locking pin 176, thereby allowing the barrel assembly 100 to be rotated downward, as depicted in FIG. 5, about the pivot pin 186.

As the barrel assembly 100 is rotated downward, the spring biased ejector assembly 160 moves rearward under the force of the spring 166. The upper edge of the curved surface 168 acts on the lower portion of the rim 114 of the cartridge case 112 to eject the round 98 from the chamber 106. A successive round 98 may then be manually loaded into the chamber 106. The barrel assembly 100 is then closed by rotating the barrel assembly 100 upward about the pivot pin 186 until the pin bore 156 on the breech locking tab 150 again engages the locking pin 176. The bevelled face 169 of the ejector assembly 160 rides on the bolt face 188 and the spring 166 of the ejector assembly 160 is thereby compressed by the action of the barrel assembly 100 being rotated into the locked disposition.

The weapon 20 with the interchangeable weapon receiver 10 is cocked manually each time that a new round 98 is loaded by pulling the charging handle 200 to the rear. The weapon 20 with the interchangeable weapon receiver 10 is aimed by raising the ramp sight 132 to its upright disposition and aiming across a suitable aperture 138 defined in the ramp sight 132 that corresponds to the desired trajectory range for the round 98. Aiming is accomplished by sighting across the selected aperture 138 and across the front sight blade 146.

Discharge of the round 98 is accomplished by squeezing the trigger assembly 50. This causes the hammer assembly to rotate forcibly into engagement with the firing pin 180. The end of the firing pin 180 is driven through the firing pin opening 190 into contact with the primer of the round 98. Such action discharges the round 98, propelling the projectile 110 from the barrel 103. After discharge, the firing pin 180 is biased to a rearward disposition by the spring 186. Such disposition retracts the firing pin 180 within the firing pin carrier 214.

The firing cycle may be repeated by again unlocking the barrel assembly 100 and rotating it downward to eject the spent cartridge case 112.

I claim:

1. An interchangeable upper receiver assembly for use with a weapon, the weapon for discharging a primary ammunition cartridge, the interchangeable upper receiver assembly for discharging at least one secondary ammunition cartridge, the secondary ammunition cartridge having a caliber that is different from a caliber of the primary ammunition cartridge, the weapon having a lower receiver assembly including a trigger assembly, a primary upper receiver assembly having a receiver, the receiver being operably removably couplable to the lower receiver assembly in an engaged disposition, the primary upper receiver assembly having a bolt assembly slidably disposed within the receiver, the bolt assembly including a firing pin slidably disposed therein, the firing pin being selectively actuatable by said trigger assembly when the primary upper receiver assembly is in the engaged disposition, a chamber for receiving the primary ammunition cartridge therein and being disposed with respect to the firing pin such that actuation of the firing pin from a cocked position to a firing position by the trigger assembly acts upon the primary ammunition cartridge to discharge said primary ammunition cartridge, the interchangeable upper receiver assembly comprising:

an integral, unitary breech block and barrel, and a bolt assembly being slidably disposed within a bolt recess defined in the breech block, the bolt assembly including a bolt housing and a firing pin slidably disposed in the bolt housing, the firing pin being selectively actuatable by said trigger assembly when the interchangeable upper receiver assembly is in the engaged disposition, a chamber for receiving the secondary ammunition cartridge therein and being disposed with respect to the firing pin such that actuation of the firing pin from a cocked position to a firing position acts upon the secondary ammunition cartridge to discharge said secondary ammunition cartridge, the interchangeable upper receiver assembly being interchangeable with the primary upper receiver assembly and operably removable couplable to the lower receiver assembly in an engaged disposition, said interchangeable upper receiver assembly converting said weapon into a single shot device, the single shot device being manually reloadable after each discharge of the secondary ammunition cartridge.

2. The interchangeable upper receiver assembly of claim 1, further comprising a sight system calibrated for a trajectory of the secondary ammunition cartridge.

3. The interchangeable upper receiver assembly of claim 1, wherein the weapon with the interchangeable upper receiver assembly installed therein is designed to discharge a cartridge selected from:

a shotgun cartridge;

a flare cartridge;

a grenade cartridge;

a chemical dispensing cartridge; and rifle and pistol cartridges different from the primary ammunition cartridge.

4. The interchangeable upper receiver assembly of claim 1, wherein the breech block and barrel is pivotable between a locked disposition with respect to the receiver and an open disposition.

5. The interchangeable upper receiver assembly of claim 4, further including an ejector assembly for ejecting the secondary ammunition cartridge when the breech block and barrel is pivoted from the locked disposition to the open disposition.

6. The interchangeable upper receiver assembly of claim 4 wherein the breech block and barrel includes a forward and a rear receiver bore defined therein, the forward and rear receiver bores being in registry with bores defined in the lower receiver assembly when the interchangeable upper receiver assembly is in the engaged disposition with the lower receiver assembly.

7. The interchangeable upper receiver assembly of claim 6, further comprising a first pin and a second pin, wherein the breech block and barrel is operably couplable to the lower receiver assembly by the respective first and second pins being removably disposed in each of the forward and rear receiver bores and the bores defined in the lower receiver assembly when the interchangeable upper receiver assembly is in the engaged disposition with the lower receiver assembly.

8. The interchangeable upper receiver assembly of claim 1, wherein the interchangeable upper receiver assembly is operably coupled to the lower receiver assembly such that actuation of the lower receiver assembly trigger assembly acts to discharge the secondary ammunition cartridge.

9. The interchangeable upper receiver assembly of claim 1, further comprising a charging handle, actuation of the charging handle acting to ready the weapon for discharge of the secondary ammunition cartridge with the secondary ammunition cartridge is loaded in the breech block and barrel.

* * * * *